US006786429B2

(12) United States Patent
Ouyoung

(10) Patent No.: US 6,786,429 B2
(45) Date of Patent: Sep. 7, 2004

(54) SPOUT CONVERTER

(75) Inventor: Scott Ouyoung, Taichung Export Processing Zone (TW)

(73) Assignee: Globe Union Industrial Corp., Taichung Export Processing Zone (TW)

( * ) Notice: Subject to any disclaimer, the term of this patent is extended or adjusted under 35 U.S.C. 154(b) by 29 days.

(21) Appl. No.: 10/323,796

(22) Filed: Dec. 20, 2002

(65) Prior Publication Data

US 2004/0124267 A1 Jul. 1, 2004

(51) Int. Cl.[7] ..... A62C 31/02

(52) U.S. Cl. ..... 239/394; 239/391; 239/390; 239/443; 239/440; 239/600

(58) Field of Search ..... 239/391, 390, 239/395, 394, 397, 443, 449, 444, 445, 446, 447, 448, 440, 600

(56) References Cited

U.S. PATENT DOCUMENTS 4,190,207 A * 2/1980 Fienhold et al. ..... 239/381
4,303,201 A * 12/1981 Elkins et al. ..... 239/381
4,588,130 A * 5/1986 Trenary et al. ..... 239/381

* cited by examiner

*Primary Examiner*—Dinh Q. Nguyen
(74) *Attorney, Agent, or Firm*—Leong C. Lei

(57) ABSTRACT

A converter threaded to the sprout of a classical faucet made of metal to compromise the classical style of the faucet allows water be delivered either in gush or divergence; a separation cover being provided to separate the heat generated from hot water flowing through the converter to avoid burning the user; and a reducing design for the rotation point of the rotation connector to avoid hurting the user.

1 Claim, 6 Drawing Sheets

SPOUT CONVERTER

BACKGROUND OF THE INVENTION (a) Field of the Invention

The present invention is related to a converter threaded to the sprout of a classic faucet to deliver the water either in gush or divergence, and more particularly, to one that prevents the handle from burning and hurting the user.

(b) Description of the Prior Art

A classic faucet without a spout converter delivers water in gush as it comes out of the spout. Even an aerator is adapted to the spout; it delivers water also in gush with added air bubbles. The direction of water delivered is fixed in one direction only. Having direct contact of the spout or the aerator when hot water is delivered may burn the hand of the user.

SUMMARY OF THE INVENTION

The primary purpose of the present invention is to provide a spout converter that many deliver the water either in gush or in divergence as desired by the user. To achieve the purpose, the spout converter of the present invention contains a base holder and the base holder is pushed up or pulled down to deliver water either in gush or in divergence.

Another purpose of the present invention is to provide a spout converter that permits changing the direction of the water delivered by deflecting the spout converter.

Another purpose yet of the present invention is to provide a spout converter that prevents the hand of the user from being burnt when hot water flows through the spout converter. To achieve the purpose, a separator cover is provided to prevent direct contact of an adjustment holder provided in the spout converter.

Another purpose yet of the present invention is to provide a spout converter that prevents the fingers of the user from being hurt upon deflecting the spout converter. To achieve the purpose, a rotation connector is completely built in a bonnet of the spout converter.

Another purpose yet of the present invention is to provide a spout converter that allows easy cleaning and service. To achieve the purpose, all components of the spout converter are threaded to one another to permit easy removal.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
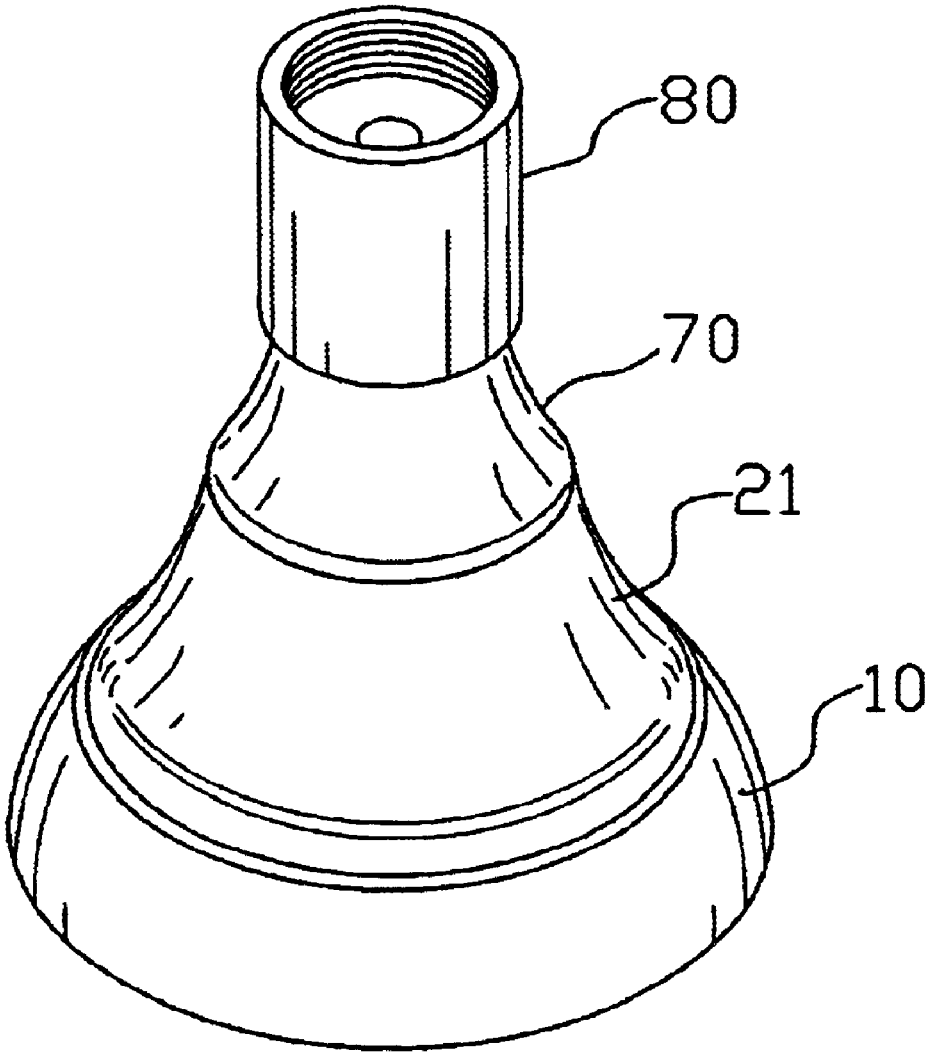
FIG. 1 is a perspective view of a preferred embodiment of the prevent invention.
Figure 2:
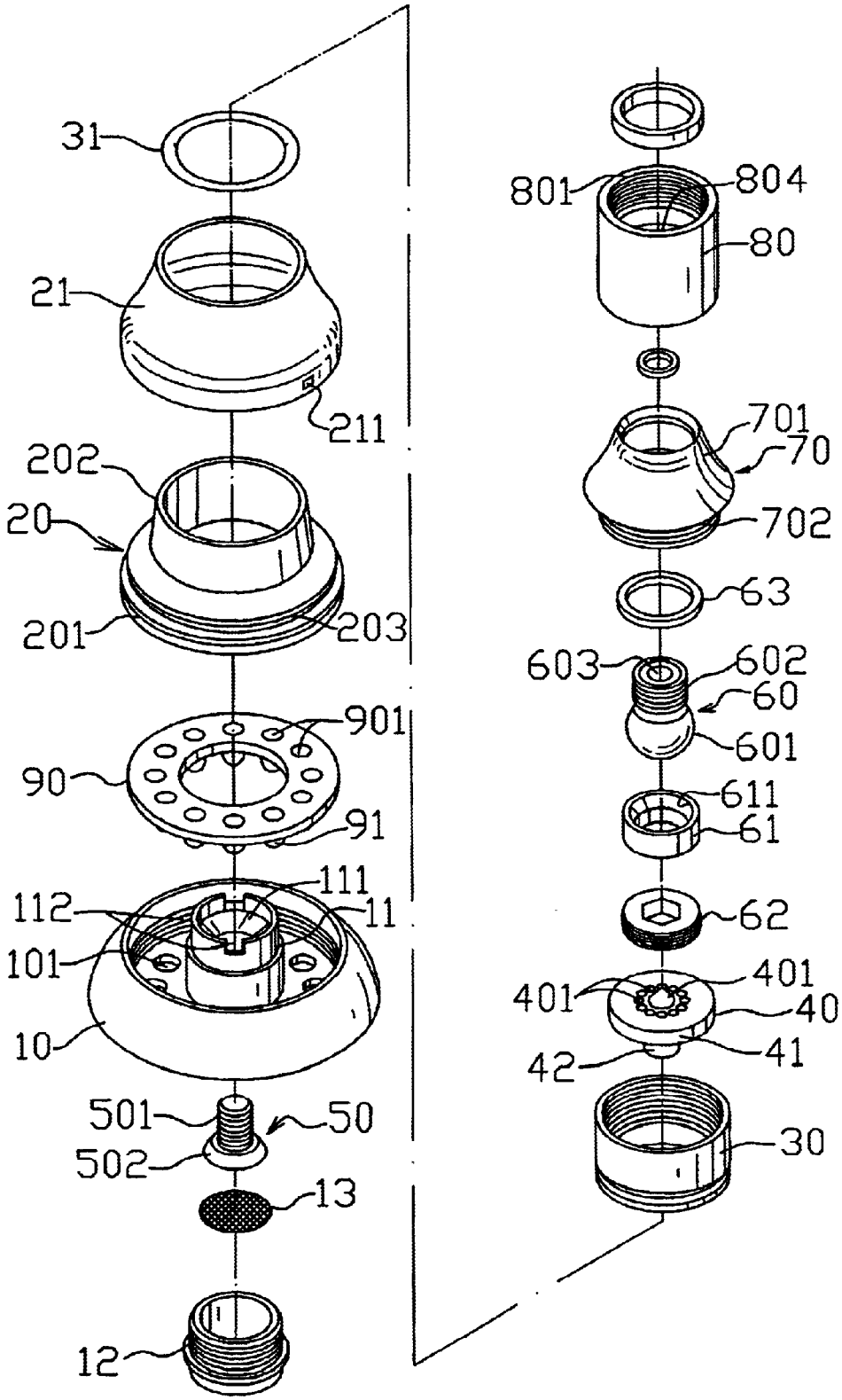
FIG. 2 is an exploded view of the preferred embodiment of the present invention.
Figure 3:
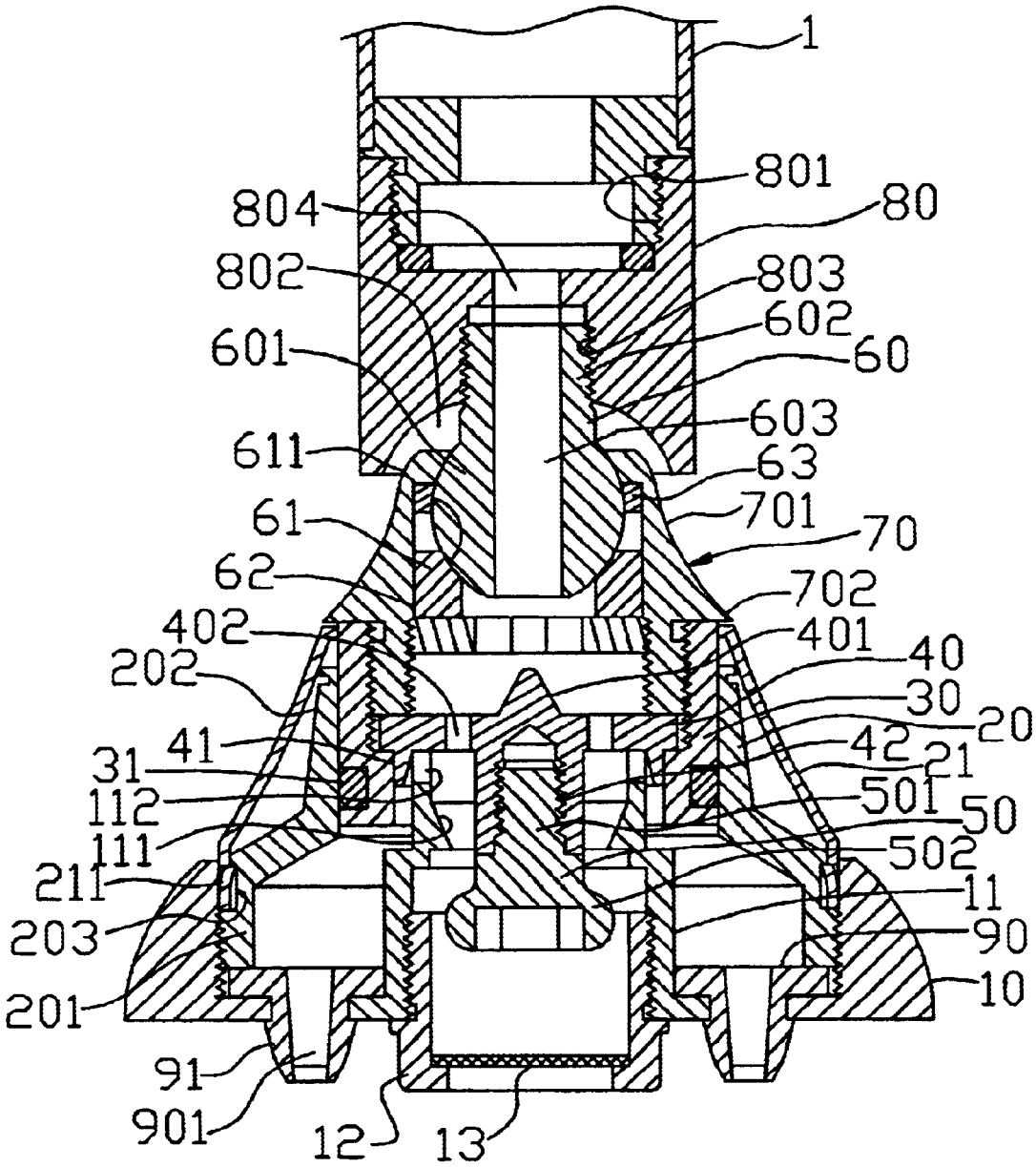
FIG. 3 is a sectional view of the preferred embodiment of the present invention.

Referring to FIGS. 1, 2 and 3, a preferred embodiment of the present invention is essentially comprised of a base holder 10, an adjustment holder 20, a coupling holder 30, a diverter 40, a plug 50, a rotation connector 60, a rotation holder 70, a bonnet 80, and a divergence gasket 90. Wherein, the base holder 10 indicates a disk shape and has an opening at its top to define a spacious interior. The inner wall of the base holder 10 is threaded and multiple circular holes 101 are arranged in a ring on a base plate in the base holder 10. A hollow stem 11 in trapezoid rises from the center of the base plate and a guide hole 111 in conic shape upside-down is provided in the upper part of the stem 11 while multiple gaps 112 are cut on the wall of the opening at the top of the stem 11. A through hole 112 with treaded inner wall in a diameter larger than that of the guide hole 111 is provided in the lower part of the stem 11. The through hole 112 is further adapted with a strainer holder 12 containing a strainer 13 and a threaded outer wall for the strainer holder 12 to be screwed inside the lower part of the stem 11.

The divergence gasket 90 made of comparatively resilient material, e.g. rubber, in sheet disk shape has a circular hole provided at its center and multiple conic studs 91 arranged in equal spacing between any two abutted studs. The quantity of those multiple conic studs 91 is the same as that of those circular holes 101 provided in the base holder 10. A conic water outlet 901 penetrating through the top is provided inside each of those studs 91. The divergence gasket is placed on the top of the base plate in the base holder 10 so that each stud 91 respectively penetrates its corresponding circular hole 101 in the base plate.

The lower part of the hollow adjustment holder 20 is related to a disk shaped coupling flange 201. The circumference of the coupling flange 201 is threaded so to engage the inner wall of the base holder 10 for the adjustment holder 20 to be coupled to the base holder 10. A female circular groove 203 is provided over the coupling flange 201. The upper part of the adjustment holder 20 in a reducing diameter smaller than that of the lower part defines an insertion part 202. A separation cover 21 has a thin wall and is made in conic shape. Multiple latches 211 with each inclined upward into the separation cover 21 are provided around the circumference at the bottom of the separation cover 21 to merely lock up the circular groove 203 of the adjustment holder 20 when the separation cover 21 covers up the adjustment holder 20.

The coupling holder 30 has its outer diameter slightly smaller than the inner diameter of the insertion part 202 of the adjustment holder 20 and a female circular groove at the bottom to accommodate a leak-proof ring 31. A trapezoid through hole is formed inside the coupling holder 30 and the inner wall of the upper part of the coupling holder 30 is threaded to engage the insertion part 202 of the adjustment holder 20.

The diverter 40 has its outer diameter slightly smaller than the diameter of the larger end of the through hole inside the coupling holder 30. A conic shaped divergence block 401 protrudes from the center of the top of the diverter 40 and multiple circular holes 402 arranged at equal spacing between any two abutted holes are provided in circular with the divergence block 401 as the center. The base of the diverter 40 is formed with a flange 41 with its outer diameter slightly smaller than the diameter of the smaller end of the through hole in the coupling holder 30. The flange 41 is used to guide airflow and has a down slope facing outwardly on its inner wall. A connection tube 42 internally threaded protrudes below the center of the bottom of the diverter 40 for the diverter 40 to be placed into the trapezoid through hole in the coupling holder 30.

The upper part of the plug 50 relates to a threaded rod 501 with its outer diameter equal to that of the connection pipe 42 of the diverter 40; and the lower part of the plug 50 relates to a head 502 with its outer diameter greater than the guide hole 111 in the stem 11 of the base holder 10. The plug 50 is inserted through the bottom of the stein 11, the guide hole 111 and finally engaged to the connection pipe of the diverter 40.

The rotation holder 70 relates to a hollow body and has it both ends open with the upper open end in smaller diameter than that of the lower open end. The inner wall of the rotation holder 70 at where approximately in middle is threaded. The upper part of the rotation holder 70 is made in a conic shape and arc surface to define a passive rotation part 701 and the lower part of the rotation holder 70 related to a coupling part 702 with its outer wall threaded is made in an outer diameter equal to the inner diameter of the coupling holder 30 for the rotation holder 70 to be engaged to the coupling holder 30.

The lower part of the rotation connector 60 relates to a rotation ball 601, and the upper part of the rotation connector 60 relates to a hollow threaded rod 602 containing a water way 603. The threaded rod 603 is first inserted with a leak-proof ring 63 before being placed into the bottom of the rotation holder 70 so that the rotation ball 601 and the leak-proof ring 63 hold against the upper open end of the rotation holder 70 while the threaded rod 602 is exposed. A positioning ring 61 made of resilient material and provided with a central hole is placed at the bottom of the rotation ball 601. A slope 611 cut at a certain inclination from the top of the central hole of the positioning ring 61 holds against the spherical surface of the rotation ball 601. Furthermore, a hollow positioning washer 62 having a threaded outer circumference is engaged to the threaded inner wall of the rotation holder 70 is used to lock up the rotation connector 60 to secure the positioning ring 61. In turn, the positioning ring 61 produces a proper compression against the rotation ball 601.

A threaded pivoting hole 801 to be engaged to the faucet is formed inside the upper part of the bonnet 80. Inside the lower part of the bonnet 80 is formed a rotation space 802 in a radius slightly greater than that of the top of the rotation holder 70. The rotation space 802 is made in an approximately semi-spherical shape. A threaded hole 803 is provided upward in the center of the rotation space 802 to be engaged to the threaded rod 602 of the rotation connector 60 with the rotation point connected to the rotation holder 70 falling within the rotation space 802. A water inlet 804 is formed over the threaded hole 803 and is connected through the pivoting hole 801 in the bonnet 80.

Figure 4:
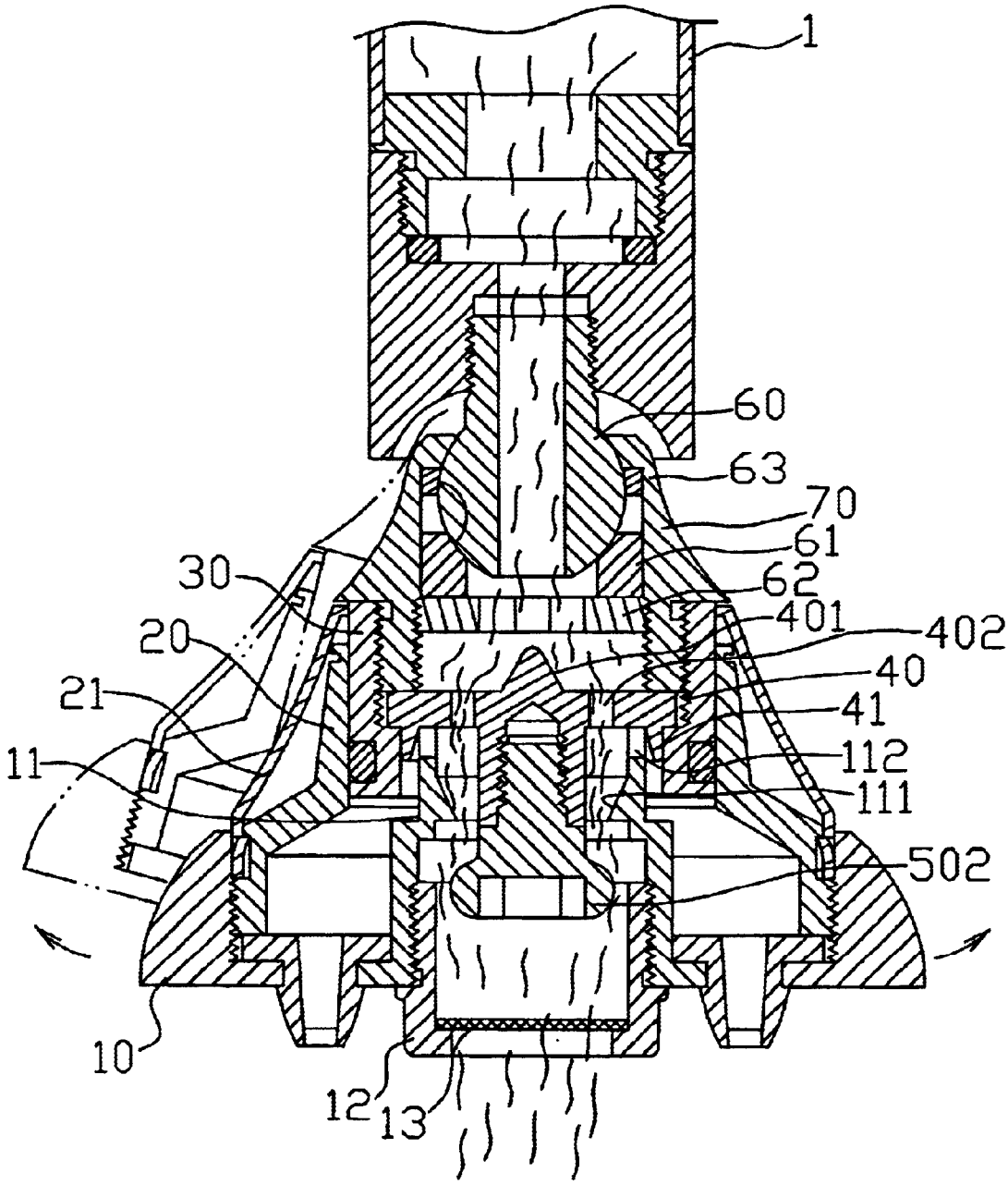
FIG. 4 is a schematic view of the preferred embodiment of the present invention in operation.
Figure 5:
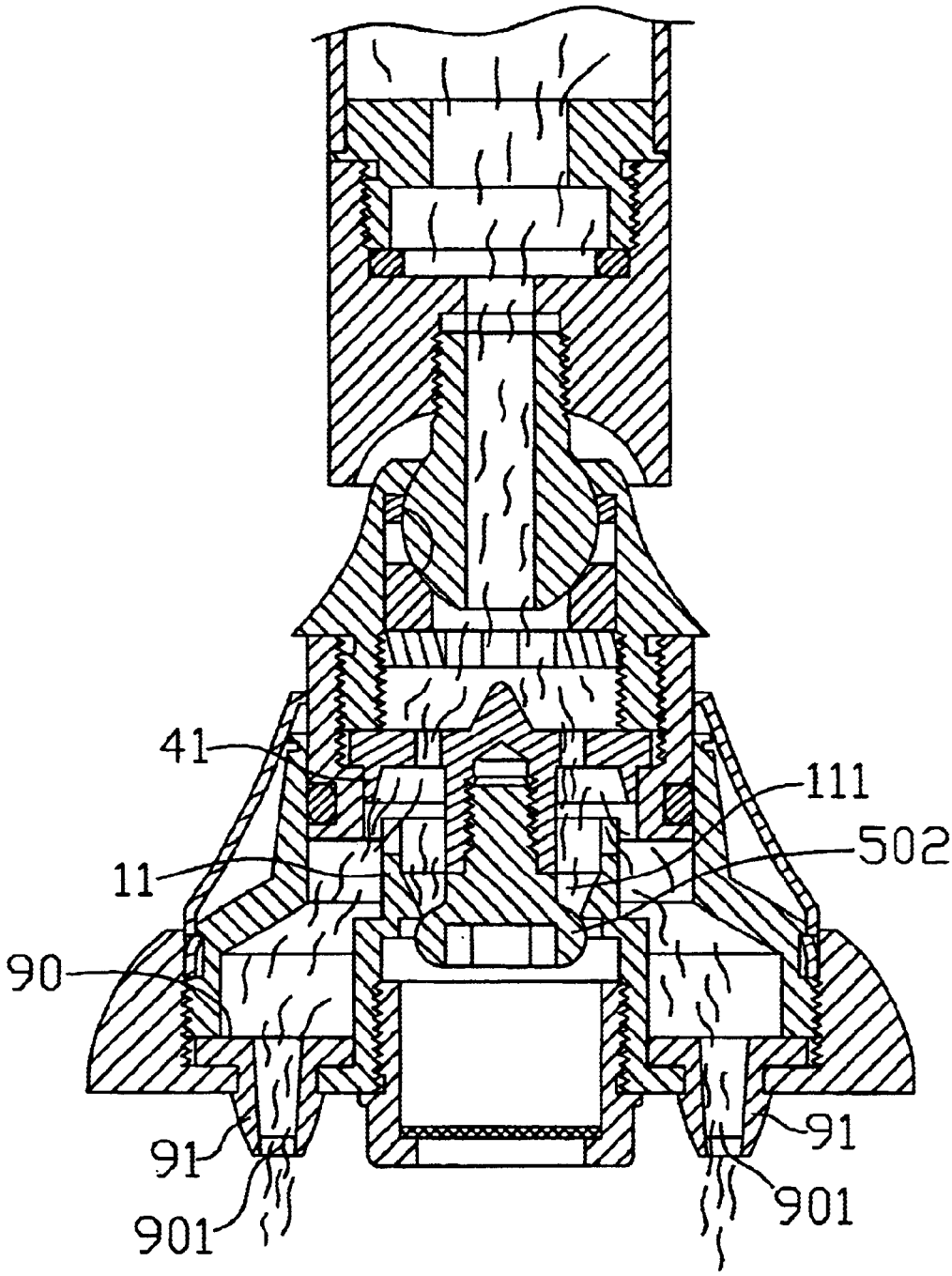
FIG. 5 is another schematic view of the preferred embodiment of the present invention in operation.
Figure 6:
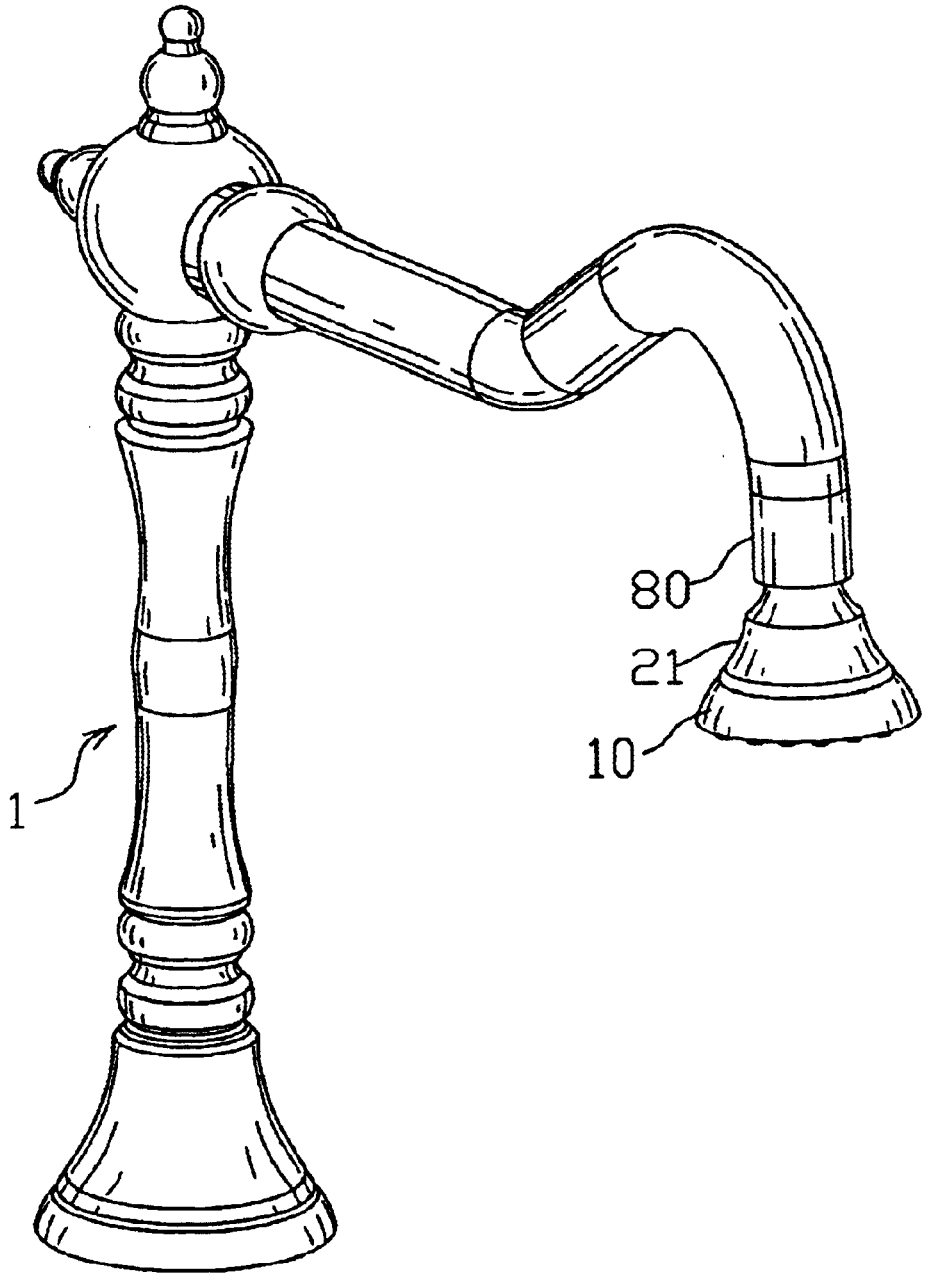
FIG. 6 is a schematic view of the preferred embodiment of the present invention adapted to a faucet.

Now referring to FIGS. 4 and 5, the bonnet 80 of the preferred embodiment of the present invention is pivoted to the spout of a faucet 1. Deflecting the spout converter as desired in conjunction with the rotation connector 60 and the rotation holder 70 may change the direction of the water delivered. As illustrated in FIG. 4, the base holder 10 of the spout converter is in a position when it is pushed up. Wherein, the stem 11, the adjustment holder and the separation cover 21 are all at their repective upper dead points to open up an area between the guide hole 111 in the stem 11 and the head 502 of the plug 50. The water from the faucet 1 flows through those circular hole 402 in the diverter 40 and turns into pressurized jet to enter into the guide hole 111 and a spacing is formed between those gaps provided in the upper inner wall of the guide hole 111 and the slope on the inner wall of the air guide flange 41 of the diverter 40. Accordingly, the air is sucked in by the spacing to mix the water flowing through the guide hole 111 at high pressure and high speed, thus to create more air bubbles for the water flowing through the strainer holder 12. On the other hand, as illustrated in FIG. 5, when the base holder 10 is pulled down, the stem 11, the adjustment holder 20 and the separation cover 21 all descend together with the base holder 10. However, the plug 50 is not displaced, thus to close up the exit of the guide hole 111 with the head 501 of the plug 50. Meanwhile, an opening is formed as the top of the stem descends to clear away from the diverter 40 to admit the water flowing through the opening into the adjustment holder 20, then through the divergence gasket 90 and outlets 901 of those studs 91, and finally to be delivered in divergence.

As disclosed above, a spout converter of the present invention by pushing up or pulling down the base holder converts the water to be delivered either in gush or in convergence and the direction of the water delivered may be changed by deflecting the spout converter. The design of the separation cover 21 prevents direct of the adjustment holder 20 upon puff up or pulling down the base holder 10; therefore, the hand of the user will not be burnt by the hot water flowing through the adjustment holder 20. As the rotation connector 60 is completely built in the bonnet 80, again, fingers of the user are prevented from being hurt when deflecting the spout converter. Furthermore, all the components of the present invention are threaded to one another to allow easy removal for cleaning and service purposes.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A spout converter for a classical faucet, made of metal, is comprised of:

a base holder, in disk shape, having an open top to define a space, inner wall threaded inside the space, multiple circular holes being provided on a base plate of the base holder, a trapezoid hollow stem being formed at a center of the base plate; a guide hole in a smaller diameter being formed on an upper part inside the stem and multiple gaps being cut at the top of the stem, and the lower part being related to a threaded hole in a greater diameter;

a divergence gasket, in sheet disk; a circular hole being provided at the center of the gasket and placed on the base plate of the base holder, multiple studs as water outlets being formed at the bottom, and each stud penetrating through its corresponding circular hole in the base plate of the base holder;

an adjustment holder, hollow, a coupling flange being provided with a threaded disk at a lower part and engaged into the base holder with its base edge contacting the divergence gasket, having its upper part formed as an insertion part in a smaller diameter, a female circular groove being provided to the coupling flange at where close to a top of the adjustment holder;

a separation cover having a thin wall, made in conic shape, multiple latches being provided around the circumference at a bottom to lock up the circular groove of the adjustment holder;

a coupling holder, in pillar shape, being placed in the insertion part of the adjustment holder, formed inside a trapezoid through hole, and inner wall being threaded;

a diverter, in disk shape, a conic shaped divergence block protruding from a center of a top, multiple circular holes arranged around the divergence block at equal spacing between any two abutted holes, a connection tube internally threaded protruding below the center of a bottom of the diverter, an air guide flange with an inner slop being formed at where close to a disk circumference, the diverter being placed in an upper hole of the coupling holder, and the air guide flange being accommodated in a lower hole of the coupling holder;

a plug, its upper part related to a threaded rod, its lower part related to a head in outer diameter greater than that of the guide hole of the stem from the base holder, the plug being inserted through a bottom of the stem, the guide hole and finally to the connection tube of the diverter, a rotation holder, hollow body, having both ends open, an upper open end in smaller diameter than that of a lower open end, inner wall being threaded, an upper part of the rotation holder being made in a conic shape and arc surface to define a passive rotation part, and the rotation holder being engaged to the coupling holder;

a rotation connector, including a rotation ball, a hollow threaded rod containing a water way, a leak-proof ring being provided at a top, a positioning ring being provided at a bottom, the rotation connector being placed into the bottom of the rotation holder, the threaded rod penetrating and being exposed out of a top of a through hole in the rotation holder, a positioning washer being engaged to the threaded inner wall of the rotation holder to lock up the rotation connector in position;

a pivoting bonnet, in cylindrical, a threaded pivoting hole in its top, a rotation shape in approximately semi-spherical shape being provided in a bottom, a threaded hole being provided upward in the center of the rotation space to be engaged to the threaded rod of the rotation connector, and a water inlet being formed connecting through the pivoting hole in the bonnet; and a stainer holder, related to a hollow pillar, having an opening in smaller diameter provided at its bottom, a strainer being placed in the bottom, an outer wall of an upper part of the holder being threaded, the strainer holder being engaged to the threaded hole at the bottom of the stem from the base holder.

* * * * *